United States Patent [19]

DiFlora

[11] Patent Number: 4,949,982

[45] Date of Patent: Aug. 21, 1990

[54] COMPRESSOR VALVE ASSEMBLY

[75] Inventor: Michael A. DiFlora, Sidney, Ohio

[73] Assignee: Copeland Corporation, Sidney, Ohio

[21] Appl. No.: 357,904

[22] Filed: May 25, 1989

Related U.S. Application Data

[62] Division of Ser. No. 20,480, Jun. 13, 1988, Pat. No. 4,854,839.

[51] Int. Cl.[5] ..... E21B 33/00; F16J 15/00

[52] U.S. Cl. ..... 277/189; 277/207 R; 277/214; 277/215; 277/235 B

[58] Field of Search ..... 277/166, 214, 189, 202 R, 277/193, 235 B, 167.5, 213, 215

[56] References Cited

U.S. PATENT DOCUMENTS

| | | | |
|---|---|---|---|
| 301,512 | 7/1884 | Mixer | 285/910 |
| 508,765 | 11/1893 | Rouse | 285/910 |
| 1,370,254 | 3/1921 | Yearsley . | |
| 1,848,307 | 3/1932 | Boynton | 277/167.5 |
| 2,344,818 | 3/1944 | Hutton . | |
| 2,725,183 | 11/4195 | Hanson . | |
| 3,090,402 | 5/1963 | St. Clair | 92/99 |
| 3,200,838 | 8/1965 | Sheaffer . | |
| 3,301,578 | 1/1967 | Platt et al. | 277/213 X |
| 3,586,338 | 6/1971 | Miklau | 277/235 B X |
| 3,926,214 | 12/1975 | Hrabal . | |
| 4,213,620 | 7/1980 | Kennedy et al. . | |
| 4,257,458 | 3/1981 | Kondo et al. . | |
| 4,325,680 | 4/1982 | Bar | 417/569 |
| 4,474,147 | 10/1984 | Hoopes | 277/235 B X |
| 4,503,347 | 3/1985 | Bergman . | |
| 4,637,619 | 1/1987 | Stansberry | 277/167.5 |
| 4,683,844 | 8/1987 | Arai et al. | 277/235 B X |
| 4,721,443 | 1/1988 | Allen . | |

FOREIGN PATENT DOCUMENTS

| | | | |
|---|---|---|---|
| 64013 | 10/1892 | Fed. Rep. of Germany | 277/207 |
| 684685 | 12/1952 | United Kingdom | 277/235 B |
| 687955 | 2/1953 | United Kingdom | 277/166 |

*Primary Examiner*—Allan N. Shoap
*Assistant Examiner*—Scott Cummings
*Attorney, Agent, or Firm*—Harness Dickey & Pierce

[57] ABSTRACT

A valve plate for a motor compressor has a continuously smooth figure-eight shaped port for reducing stresses along the primary longitudinal axis of a reed valve associated with the port, and an arrangement for providing a mechanical interlock for a head gasket to inhibit pressure loss between adjacent compressor cylinders.

7 Claims, 2 Drawing Sheets

COMPRESSOR VALVE ASSEMBLY

This is a division of U.S. patent application Ser. No. 20,480, filed June 13, 1988, now U.S. Pat. No. 4,854,839.

BACKGROUND AND SUMMARY OF THE INVENTION

This invention relates to pressure responsive valve assemblies adapted for use in reciprocating piston-type compressors, such as refrigeration compressors, and more particularly to an improved port design and sealing arrangement for such valve assemblies.

Reciprocating piston-type compressors include suction and discharge pressure actuated valving mounted at the end of the cylinder between the cylinder head and the cylinder housing. In designing these valve assemblies it is important to overall system operation to provide a sufficiently large port are to permit passing the maximum volume of gas within a given time period and at an acceptably small pressure drop. This is particularly true for refrigeration compressors because of relatively high mass flow rates.

Associated with the desirability to maximize port area for a given size cylinder is the need to reduce the stress in the moving reed member without adversely affecting its ability to close the port. In prior apparatus these ports have been configured to be generally circular and/or slightly rectangular or racetrack in shape. In situations wherein the refrigeration gas has not been fully vaporized, the compressor tries to pump liquid, resulting in what is termed "slugging". In this situation, the extremely high cylinder pressures generated (e.g., 1,000 psi or more) can cause the suction valve read to bend or deform thereby not completely closing the port and in extreme cases the slugging could cause the valve reed to be pushed through the suction port.

A gasket disposed between the compressor body and the valve plate is typically used to inhibit leakage between the compression cylinders. Hermetic-type compressors are tightly sealed such that if the gasket should fail due the high pressure differential between the ports, the compressor cannot be easily serviced. Accordingly, an enhanced gasket retention arrangement is desirable.

It is an object of this invention to provide a motor compressor assembly wherein the stress in the reed valve is reduced. In this regard, there is provided a unique port design which enhances the resistance of a reed to failure from fatigue or slugging. A benefit of such an arrangement is that for the same reed shape a reduction in the thickness (and thus the mass) of the read can be utilized to reduce impact stresses and noise and increase response.

It is a further object of this invention to provide an arrangement which ensures that the seal between the compression cylinders is maintained. In this regard there is provided a unique gasket mounting arrangement which provides a mechanical interlock with the gasket when sandwiched between the compressor body and valve plate. A benefit of such an arrangement is the prevention of gasket blow-out which can be caused by the extreme pressure differentials as the pistons reciprocate in their respective adjacent cylinders.

The foregoing and other objects will become more apparent when viewed in light of the accompanying drawings and following detailed description wherein.

Figure 1:
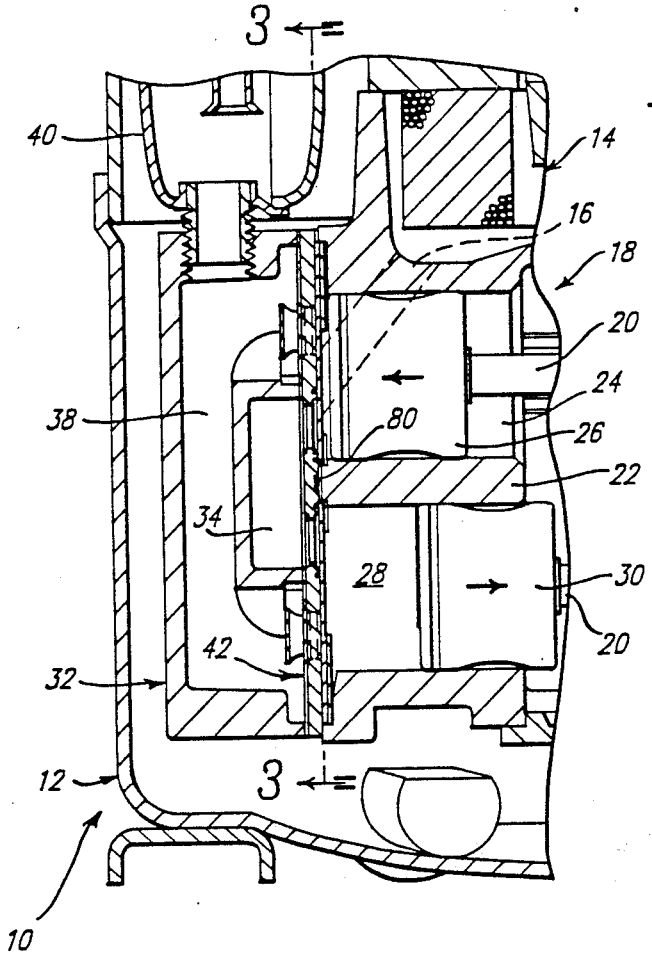
FIG. 1 is a partially diagrammatic vertical cross-sectional view of a portion of a hermetic refrigeration motor compressor incorporating a valve assembly according to the present invention.

Referring now to the drawings, there is illustrated a hermetic motor compressor generally indicated at 10 and of a type widely known in the refrigeration trade. While the compressor will be described in general, a more detailed description is found in U.S. Pat. No. 4,503,347 issued Mar. 5, 1985 to Bergman, the patent being specifically incorporated herein by reference. The motor compressor 10 includes an outer shell 12 having adjacent the top thereof a suction inlet (not shown), a motor 14 cooled by the suction gas, a compressor 18 drivingly connected to the motor and a plurality of suction gas passages 16 in the compressor communicating with the inlet, the motor and compressor being hermetically encapsulated interiorly of the shell.

The compressor 18 includes a crankshaft (not shown) driven by the motor, a cylinder body 22 including a pair of cylinders 242 and 28, a pair of pistons 26 and 30 each disposed for reciprocation in a respective cylinder 24 and 28 and drivingly connected to the crankshaft via connecting rods 20, a cylinder head 32 covering the cylinders and bolted securely to the cylinder body and a valve plate 42 sandwiched between the cylinder head and the cylinder body. The cylinder head 32 has a chamber 34 for receiving suction gas from the passage 16 and supplying same to the cylinders 24 and 28, and a chamber 38 for receiving compressed discharge gas from the cylinders 24 and 28 and supplying same to a muffler 40.

The valve plate 42 is generally flat and rectangular in shape having a longitudinal dimension greater than its lateral dimension and includes a top surface 44 facing the cylinder head, a bottom surface 46 facing the cylinder body, an array of ports 50, 52 and 54 extending between the surfaces for supplying and discharging gas to and from the cylinders, and suction and discharge reeds 56 and 64 for periodically opening and closing respective of the ports depending upon the direction of motion of the piston in its respective cylinder. Bolt holes 48 are disposed around the perimeter of the plate each being aligned with corresponding bolt holes in the cylinder head 32 and cylinder body 22 whereby the plate may be secured to the cylinder body at the same time the cylinder head is secured to the compressor 18. Suction gas passes from inlet passages 16 through respective valve ports 50 into the chamber 34 from which it passes through suction gas ports 54 into cylinders 24 and 28. The compressed gas is discharged from the cylinders 24 and 28 through discharge ports 52, each cylinder having a set of three cylindrical bores or ports with the center bore thereof being the largest and each bore communicating with chambers 38. The discharge ports 52 of each set have their centers on a common lateral axis parallel to the other lateral axes.

The suction ports 50 and 54 are symmetrically disposed on a grid defined by orthogonal axes which are parallel and perpendicular to one another with two longitudinal axes each extending through the centers of two respective ports 50, two longitudinal axes each extending through two respective ports 54, and two lateral axes each extending, respectively, through two ports 50 and two ports 54.

Two L-shaped discharge reeds 56 are fastened to the top surface 44 of the plate, each reed extending in covering relation over one set of discharge ports 52. Each reed 56 has a foot 58 secured to the plate adjacent an opposite respective longitudinal edge of the plate and a centrally widened body portion 60 for covering the center discharge port 52. An L-shaped retainer plate 62 having the same general shape as reed 56 is secured to the plate in overlying relationship with reed 56 to limit upward deflection of reed 56, in the conventional manner.

Two U-shaped suction valve reeds 64, each having the usual U-shaped backing plate 63, are fastened to bottom surface 46 of the plate with each reed being suitably configured for covering one set of suction ports 54. Reed 64 includes a pair of racetrack-shaped (i.e., rectangular with semi-circular ends) legs 66 and a bight 68, the legs extending from the bight and the bight being secured to the plate in the usual manner. The center discharge gas port is disposed between the two reed legs 66. Operation of the piston in a direction away from the plate causes the free end of each leg 66 to deflect inwardly to open the suction port.

Figure 4:
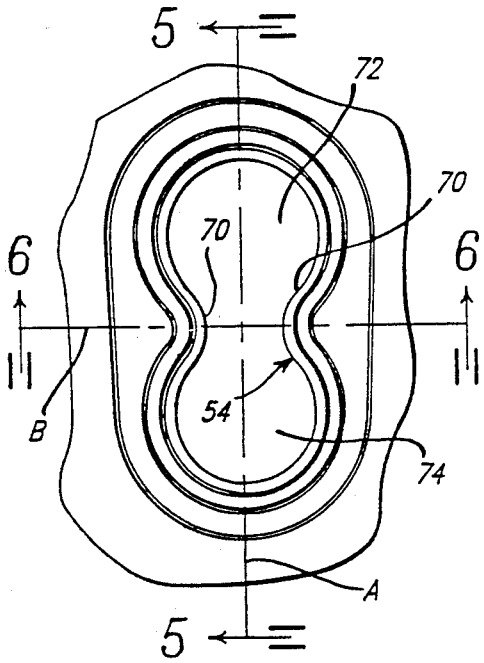
FIG. 4 is an enlarged view of a suction port in the valve assembly according to this invention.
Figure 6:
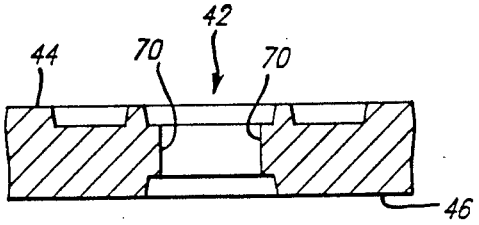
FIG. 6 is a cross-sectional view of the port taken along line 6—6 of FIG. 4.

In accord with this invention it has been found that a continuously smooth, cusp-free, contoured figure-eight shaped suction gas port 54 having two lobes 72 and 74 defining lateral portions 70 for supporting the lateral span of the reed leg 66 reduces stress in the reed leg to an unexpected degree without requiring an increase in reed thickness. Referring to FIG. 4, "A" is the center longitudinal axis of the port and "B" is a transverse axis centered between the longitudinal ends of the port. The side wall forming each lobe 72 and 74 is generally defined by a circular cylinder having its center disposed on longitudinal axis "A". The port has an overall length approximately equal to twice the diameter of the larger lobe, the center of the latter being spaced from axis "B" by an amount approximately equal to the radius of the larger lobe (i.e., axis "B" is generally tangent to the imaginary circle defining the larger lobe). Each lobe 72 and 74 is preferably formed of a different diameter, with the smaller diameter lobe being disposed at the free end of the suction reed. This diameter is chosen by starting with the diameter of the larger inner lobe and reducing it until the stress on the reed (normally higher at the free end because of greater deflection) over the outer lobe is substantially equal to the stress over the inner lobe. This can be done using standard finite analysis techniques. The side wall forming each support area 70 is generally defined by a circular cylinder which blends into the side walls of each lobe 72 and 74 in a smooth transition. Support areas 70 extend laterally towards one another to define landings which support the medial portion of each reed leg 66, thereby reducing the tension/compression stresses along the major longitudinal/lateral axes of the reed when the latter is subjected to extreme compression pressures. The overall port is symmetrical about axis "A".

It has been discovered that if the diameter of lobe 72 is approximately 15 percent greater than the diameter of lobe 74, and the lateral separation between support areas 70 is approximately 50 percent of the lateral dimension of one lobe, surprising results are obtained.

A figure-eight shaped port with two equal-diametered lobes surprisingly can provide a 22% to 35% reduction in stress along the longitudinal length of a reed having a racetrack shape when compared to the longitudinal stress in a reed superposing a corresponding racetrack-shaped port, such as used by the prior designs; whereas a modified figure-eight shaped port characterized by unequal-diameter lobes unexpectedly provides a 37% to 40% reduction in stress. It is believed that the continuously smooth two-diameter tow-lobed port provides adequate escape perimeter while significantly reducing reed stress because the area that supports the reed is brought partially into the center, near the highest stress area. The slightly smaller outer port also provides additional support surface for the valve reed. Further, because the figure-eight port reduces reed stresses the suction reed can be reduced in thickness and still handle slugging. A reed having a reduced mass will accordingly cycle faster and reduce the impact noise during operation of the compressor.

Figure 2:
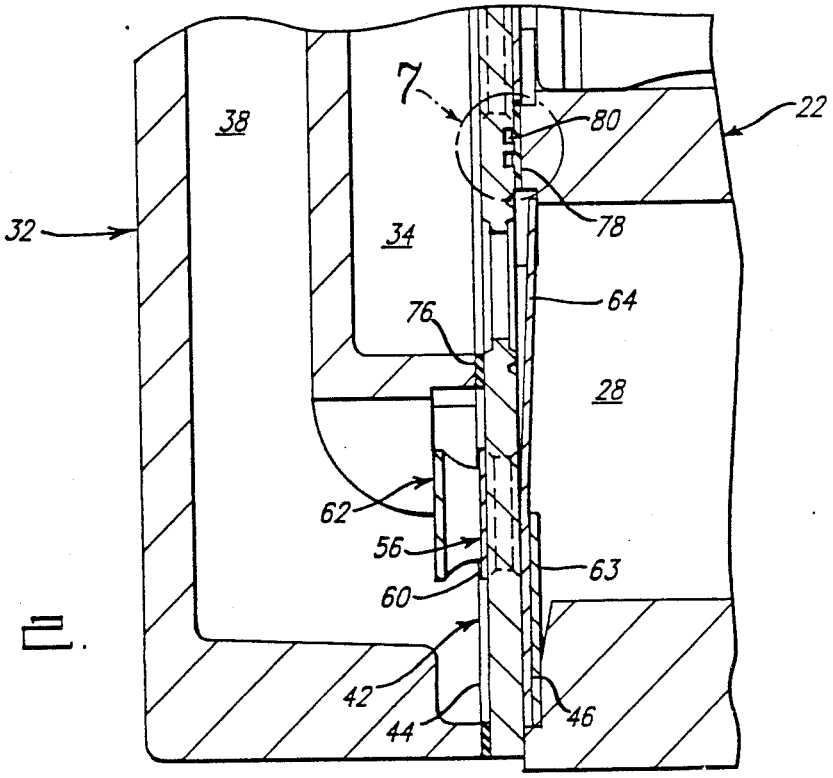
FIG. 2 is an enlarged cross-sectional view of a portion of the valve assembly shown in FIG. 1.
Figure 3:
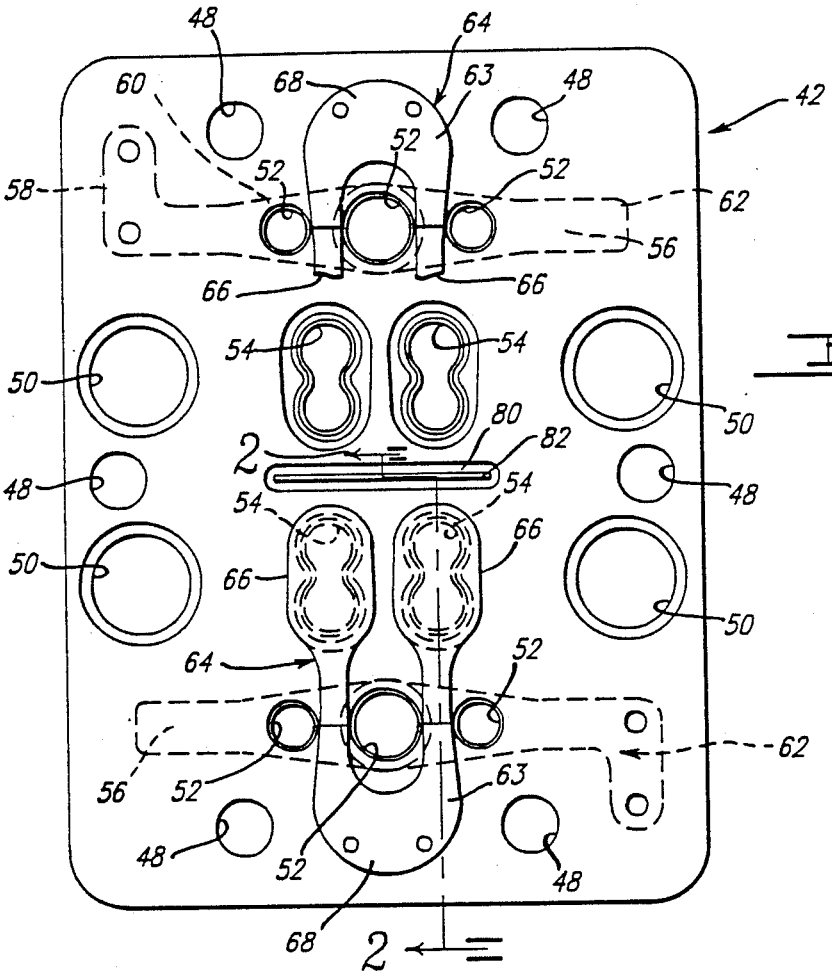
FIG. 3 is a plan view of the valve plate assembly taken from line 3—3 of FIG. 1.
Figure 5:
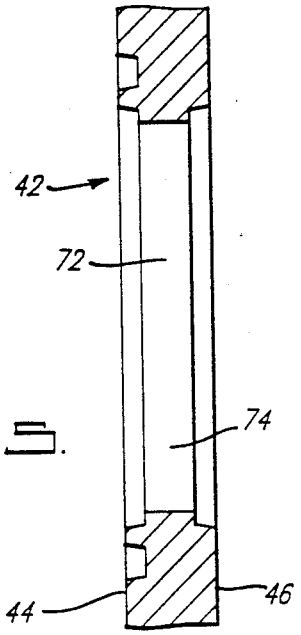
FIG. 5 is a cross-sectional view of the port taken along line 5—5 of FIG. 4.

When the compressor is assembled (FIGS. 1 and 2) a pair of gaskets 76 and 78 are used in conjunction with plate 42 to maintain pressure during operation, gasket 76 being compressed between cylinder head 32 and surface 44 of plate 42 and gasket 76 being compressed between cylinder body 22 and surface 46 of plate 42.

Figure 7:
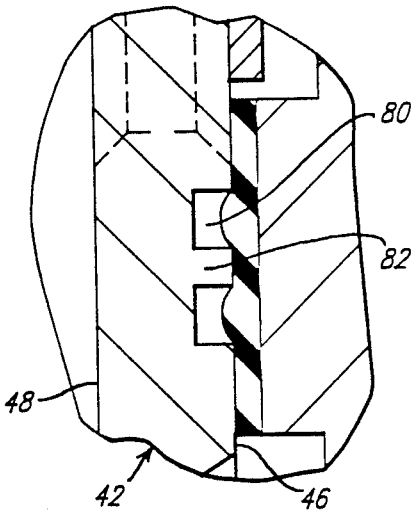
FIG. 7 is an enlarged cross-sectional view of the gasket interlock shown in the circle indicated at 7 in FIG. 2.

In accordance with another feature of this invention, surface 46 includes in the relatively narrow space between adjoining cylinders an elongated O-shaped annular groove 80 defining in the center a locking rib 82. Clamping of the plate to cylinder body 22 (see FIG. 7) causes portions of gasket 78 to be deformed into recess 80 with rib 82 and the outer edges of groove 80 grippingly engaging the gasket to prevent lateral movement of the gasket. It is to be appreciated that groove 80 is located in an area which is exposed to very high pressure differentials between the cylinders. The mechanical interlock created by groove 80 prevents extrusion of the gasket from a high pressure cylinder to a low pressure cylinder. It should be noted that the interlocking groove could alternatively, or in addition, be provided on the cylinder body and/or cylinder head, and can also be similarly provided for the gasket 76.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

What is claimed is:

1. A high pressure seal arrangement for preventing fluid leakage between adjacent compression chambers of a compressor having a body defining said chambers, a valve plate affixed thereto and closing said chambers, said body and valve plate having mating faces, and a gasket disposed between the mating faces of said body and plate, said arrangement characterized by one of said mating faces comprising a groove with portions of said gasket being extruded into said groove to form a mechanical interlock resisting lateral movement.

2. A high pressure seal arrangement as claimed in claim 1 wherein said groove is a continuous annular groove.

3. A high pressure seal arrangement as claimed in claim 1 wherein said groove is axially elongated, with a major axis thereof being generally transverse to the direction leakage tends to occur.

4. A high pressure seal arrangement as claimed in claim 3 wherein said groove is an axially elongated continuous annular groove defining a central rib which contributes to said mechanical interlock.

5. A high pressure seal arrangement as claimed in claim 1, wherein said mating surfaces are generally planar.

6. A high pressure seal arrangement as claimed in claim 3, wherein said groove is annular and includes an axially elongated central rib which is generally symmetrically disposed with respect to said groove and substantially axially co-extensive with said groove.

7. A high pressure seal arrangement as claimed in claim 6, wherein said groove has a generally uniform depth into said one mating face and said gasket has a thickness dimensioned such that the gasket material generally uniformally extrudes into the groove and fills less than the entire volume of the groove.

* * * * *

UNITED STATES PATENT AND TRADEMARK OFFICE

CERTIFICATE OF CORRECTION

PATENT NO. : 4,949,982

DATED : August 21, 1990

INVENTOR(S) : Michael A. DiFlora

It is certified that error appears in the above-identified patent and that said Letters Patent is hereby corrected as shown below:

On the title page, in item [56]:

In the references: Hanson 2,725,183 dated "11/4195" should be -- 11/1955--

Title page, under Related U.S. Application Data: Ser. No. "20,480" should be -- 206,480 --.

Column 1, line 5, "20,480" should be -- 206,480 --.

Column 1, line 19, "are" should be -- area --.

Column 1, line 52, "read" should be -- reed --.

Column 2, line 32, "242" should be -- 24 --.

Column 4, line 13, "tow" should be -- two --.

Column 4, line 29, "76" should be -- 78 --.

Signed and Sealed this

Thirtieth Day of June, 1992

*Attest:*

DOUGLAS B. COMER

*Attesting Officer*

*Acting Commissioner of Patents and Trademarks*